US007733199B2

(12) United States Patent
Dauer et al.

(10) Patent No.: US 7,733,199 B2
(45) Date of Patent: Jun. 8, 2010

(54) ELECTRICAL CIRCUIT BREAKER HAVING A PROTECTIVE FUNCTION

(75) Inventors: Klaus Dauer, Koblenz (DE); Guenter Baujan, Troisdorf (DE); Anke Juelich, Rheinbach (DE)

(73) Assignee: Moeller GmbH, Bonn (DE)

( * ) Notice: Subject to any disclaimer, the term of this patent is extended or adjusted under 35 U.S.C. 154(b) by 436 days.

(21) Appl. No.: 11/719,877

(22) PCT Filed: Aug. 4, 2006

(86) PCT No.: PCT/EP2006/007715

§ 371 (c)(1),
(2), (4) Date: May 22, 2007

(87) PCT Pub. No.: WO2007/017188

PCT Pub. Date: Feb. 15, 2007

(65) Prior Publication Data

US 2009/0167468 A1 Jul. 2, 2009

(30) Foreign Application Priority Data

Aug. 9, 2005 (DE) ..... 10 2005 037 437

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 73/12*** | (2006.01) |
| ***H01H 83/06*** | (2006.01) |
| ***H01H 73/02*** | (2006.01) |

(52) U.S. Cl. ..... 335/21; 335/6; 335/18

(58) Field of Classification Search ..... 335/6, 335/18, 21

See application file for complete search history.

(56) References Cited

U.S. PATENT DOCUMENTS

| | | | | |
|---|---|---|---|---|
| 4,013,926 | A | 3/1977 | Lang et al. | |
| 4,104,601 | A | 8/1978 | Gryctko | |
| 5,089,796 | A * | 2/1992 | Glennon et al. | 335/172 |
| 5,331,301 | A * | 7/1994 | Glennon et al. | 335/20 |
| 6,388,858 | B1 * | 5/2002 | Simms et al. | 361/115 |
| 6,469,600 | B1 * | 10/2002 | Seese et al. | 335/6 |

(Continued)

FOREIGN PATENT DOCUMENTS

| | | |
|---|---|---|
| DE | 4106652 | 9/1992 |

(Continued)

*Primary Examiner*—Elvin G Enad
*Assistant Examiner*—Alexander Talpalatskiy
(74) *Attorney, Agent, or Firm*—Leydig, Voit & Mayer, Ltd.

(57) ABSTRACT

An actuating unit or actuating mechanism and release for a circuit breaker. The magnetic mechanism of the release includes a magnet armature, which can move linearly in a magnet coil, is in the form of a tripping plunger and can be moved towards a permanent magnet counter to the force of a storage compression spring and is held fixedly by said permanent magnet in the case of a magnet coil through which no current is flowing. The tripping unit is in the form of a mechanical force store. After a tripping action, the mechanical force store needs to be reset manually again. For this purpose, a rotary movement of the drive shaft with an angular displacement of from 20 to 30 degrees takes place in the opposite direction to the ON switching rotary movement.

6 Claims, 3 Drawing Sheets

U.S. PATENT DOCUMENTS

| | | | | |
|---|---|---|---|---|
| 6,507,255 | B1 * | 1/2003 | Ennis et al. | 335/6 |
| 6,768,402 | B2 * | 7/2004 | Davidson et al. | 335/14 |
| 6,812,815 | B2 * | 11/2004 | Simms et al. | 335/6 |
| 6,946,935 | B2 * | 9/2005 | Wu et al. | 335/18 |

FOREIGN PATENT DOCUMENTS

| | | |
|---|---|---|
| DE | 19741919 | 3/1999 |
| DE | 19836549 | 2/2000 |
| GB | 1550485 | 8/1979 |
| GB | 1558785 | 1/1980 |

* cited by examiner

ELECTRICAL CIRCUIT BREAKER HAVING A PROTECTIVE FUNCTION

The invention relates to an electrical circuit breaker with a protective function in case of a fault. Such circuit breakers comprise a switch mechanism, current paths with disconnectable contacts, an electromagnetic tripping unit, an electromagnetic control module that regulates in case of a fault, and a manual actuator unit for switching on and off as well as for resetting the tripping unit after it has been tripped. In response to a switch-OFF command, the tripping unit acts mechanically on the switch mechanism (for purposes of opening a biased latch or the contacts).

BACKGROUND

Circuit breakers of this type can be configured as motor circuit breakers or as automatic circuit breakers that are employed to switch a load on and off and that have a protective function by separating or interrupting the load in case of an electrical fault. Electrical faults can be short circuits, overcurrents or else undervoltages. Examples of typical circuit breakers are also residual current circuit breakers (for instance, German patent application DE 4106652 A1) which, however, cannot be utilized to switch loads on and off.

An example of a circuit breaker of the generic type is presented in German patent application DE 198 36 549 A1. The tripping unit can be of the conventional type, for instance, like the one described in GB 1,558,785. Here, the magnetic mechanism consists of a solenoid armature which can move linearly in a solenoid coil and which is configured as a tripping tappet that can be moved towards a permanent magnet against the force of a pressure spring by means of which it is held in place when the solenoid coil is de-energized.

In the case of many circuit breakers, the space available for the installation of a tripping unit is small. In view of the low voltage level, this is an economical solution for use in the automotive sector (German patent specification DE 197 41 919 C1). However, for low-voltage applications, higher requirements in terms of insulation and higher switching capacities have to be achieved.

SUMMARY OF THE INVENTION

An object of the present invention is to provide a particularly compact configuration of an actuator unit or actuator mechanism and of a tripping device for a circuit breaker.

The present invention provides an actuator unit configured as a rotating mechanism having a drive shaft which is operatively connected to the switch mechanism for switching on and off, and between the drive shaft and the tripping unit, a mechanical operative connection by means of which the magnetic mechanism of the tripping unit is reset when the drive shaft is moved out of its OFF position in the direction opposite from the rotational movement for switching on.

The switch concept is the principle of the energetically self-supplied tripping concept. In other words, the tripping unit is without power supply when it is in the activated position and, with a relatively small current surge, it is capable of triggering the latch so as to open the contacts. In order to achieve this task, the tripping unit is configured as an energy storage mechanism. Following a tripping action, the energy storage mechanism has to be manually reset. The circuit breaker cannot be moved from its OFF position into the ON position if the tripping unit has not been previously reset.

It is proposed for the resetting movement of the tripping unit to be executed by the rotational movement of the drive shaft at an angular displacement of 20° to 30° in the direction opposite from the rotational movement for switching on. According to the invention, the operative connection between the actuator unit and the tripping lever that constitutes the tripping unit is a double-arm lever whose first arm is acted upon by at least one catch means on the drive shaft and whose second arm brings about the resetting movement of the tripping unit.

With the application of deformation work by the pressure spring, the second arm moves the solenoid armature of the energy storage mechanism over to the permanent magnet, whereby the solenoid armature (tripping tappet) is held in place by the holding force of the permanent magnet.

The tripping takes place due to a current surge through a magnetic circuit whose generated magnetic flux overcomes the holding force of the permanent magnet. As a result of the movement of the solenoid armature into the tripped position, the switch mechanism and the drive shaft are mechanically moved, whereby the latch is actuated and the switch mechanism opens and the drive shaft executes a rotational movement (into the OFF position).

The inventive arrangement can be used both as a single-pole circuit breaker and as a multi-pole circuit breaker.

The mechanical actuator unit can be arranged on the top of a circuit breaker, as a result of which the size of the circuit breaker only increases in terms of height (vertically); no changes occur in the horizontal extension (in terms of the installation dimensions).

The geometry of the involved manual actuator unit and its association with the tripping unit are configured in such a way that the double-arm lever is mounted axially parallel to the drive shaft (actuating shaft) and the solenoid armature is mounted perpendicular to the double-arm lever. In this context, a mechanical operative connection is created between the drive shaft and the magnetic mechanism in such a way that a rotation of the drive shaft is converted into a counter-rotation of the double-arm lever and the rotation of the double-arm lever becomes a linear movement of the solenoid armature. When the drive shaft is rotated by about 25° for the resetting movement, the solenoid armature moves by about 2.5 mm. The mechanical design is such that the second arm of the double-arm lever is configured as a prong and the solenoid armature is provided with a groove so as to engage with the prong.

The drive shaft is created by assembling an actuating shaft and a receiving shaft. This is comprehensively explained in the description of the figures.

A preferably colored marking can be placed on one arm of the double-arm lever. Here, a window is provided in the housing of the circuit breaker in such a way that the marking can be seen through the window from the outside when the tripping unit is either in the reset position or in the tripped position. This allows a user to directly see whether the circuit breaker circuit breaker can be switched on, without resetting, or whether the tripping unit still has to be reset before the circuit breaker can be switched on.

BRIEF DESCRIPTION OF THE DRAWINGS

An embodiment of the invention is presented in the figures, which show the following in greater detail.

DETAILED DESCRIPTION

Figure 1:
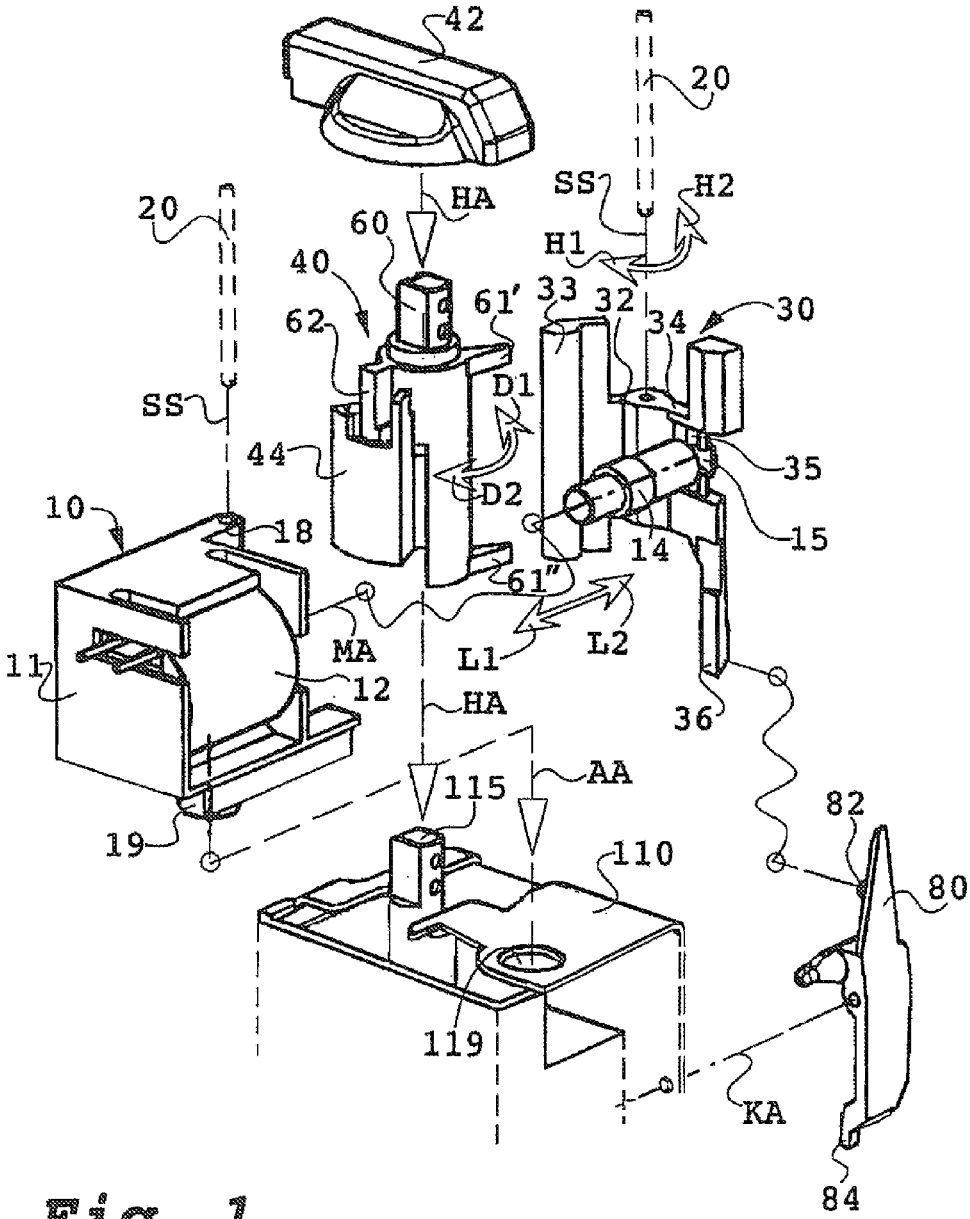
FIG. 1—individual parts in an exploded view.

The actuating button 42 configured as a knob is affixed at the end of a drive shaft 40 included in the actuator unit 140 and it extends beyond the housing (not shown here) of the circuit breaker. The drive shaft 40 is a multi-component assembly consisting of the actuating shaft 44 and the receiving shaft 60. This assembly is shown and described separately and comprehensively in FIG. 2.

From the outside, all that can be seen of the circuit breaker is the knob 42 that can be in an OFF position and in an ON position, which are offset from each other by 90°. In the ON position, the contacts are closed and the tripping unit can be activated. From this position, the contacts of the circuit breaker can be manually opened by turning the drive shaft 40 counterclockwise D1 by means of the knob 42. The drive shaft releases the latch in the switch mechanism and opens the contacts. For the manual switch-OFF, a brief rotation in the D1 direction is sufficient in order to actuate the latch. Rotation by a full 90° is not necessary for this purpose. When the circuit breaker is automatically switched off in case of a fault and the contacts are opened, the drive shaft 40 is automatically moved along as well.

In the switched-off state of the circuit breaker (latch/contacts open), it is not possible to directly move the circuit breaker into the switched-on state. The tripping unit 10 works as an energy storage mechanism and first has to be biased. The tripping unit 10 has a pot-shaped magnetic circuit and it works with the holding force of the permanent magnet. One end of the solenoid armature 14 that can be moved in the magnetic circuit interacts magnetically with a permanent magnet 16 while the other end is configured as a tripping tappet. The solenoid armature 14 is acted upon by a pressure spring 17.

Figure 3:
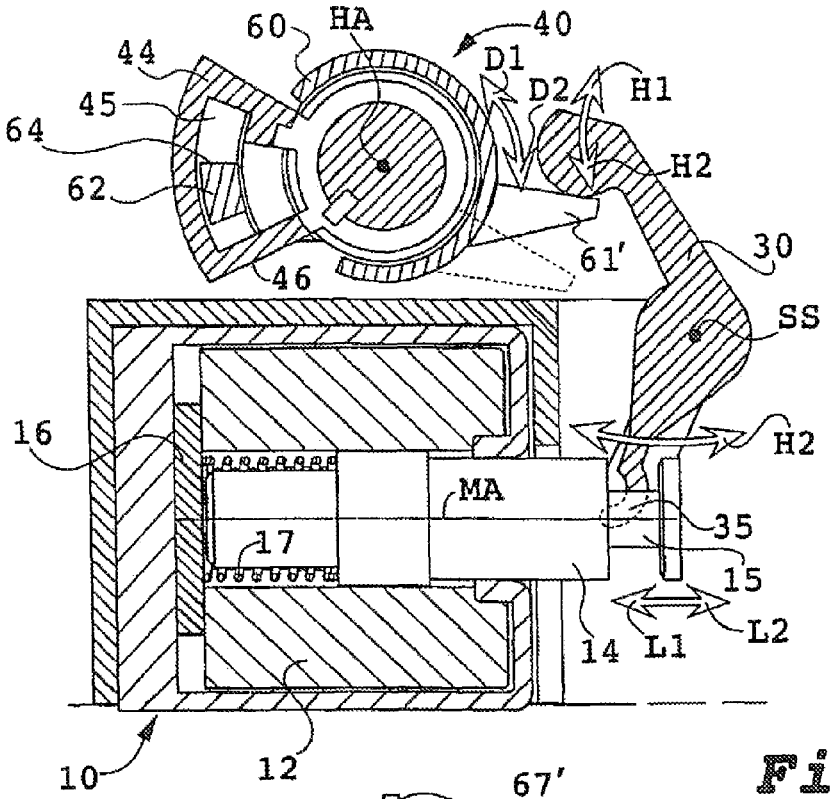
FIG. 3—a horizontal section through the arrangement.
Figure 4:
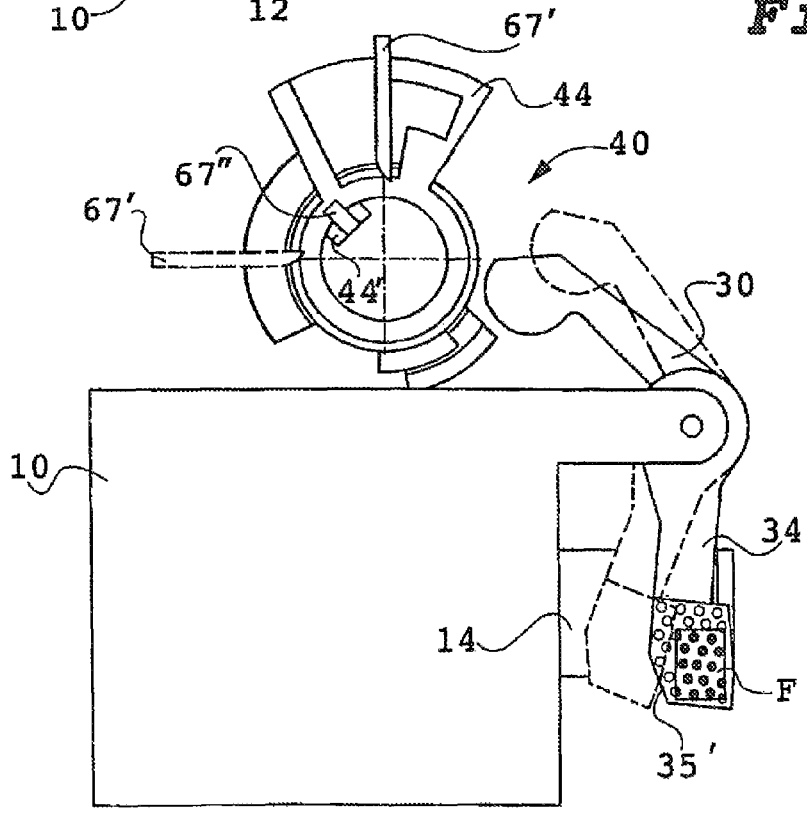
FIG. 4—the tripping unit with the double-arm lever and driveshaft.

The axis HA of the actuating shaft is very close to the housing 11 of the tripping unit 10 (also see FIGS. 3 and 4). The double-arm lever 30 is mounted axially parallel to the actuating shaft 44 and the solenoid armature 14 is mounted perpendicular to the double-arm lever 30.

The tripping unit is activated by manually turning the knob 42 (of the drive shaft 40) counterclockwise D1 around the axis HA of the drive shaft 40 out of the OFF position by about 20° to 30°, in other words, in the direction opposite from the movement for switching on. By means of this manual actuation, the energy storage mechanism is moved into the switched-on position. When the knob 42 is turned in the direction (D1) counter to the movement for switching on, two catch lugs 61', 61" engage operatively with the first arm 32 of the tripping lever 30 configured as a double-arm lever. The rotation of the actuating shaft is converted into a rotation of the double-arm lever in the opposite direction (reference numerals H1, H2). This actuation follows the action chain consisting of the knob 42, the drive shaft 40, the catch lugs 61', 61", the double-arm lever 30, the prong 35, the solenoid armature 14 and the permanent magnet 16. The solenoid armature 14 is moved over to the permanent magnet, where it is held in place magnetically.

It has already been mentioned that the latch cannot be switched on without actuating the power drive. The latch is locked and released by a locking pawl 80 biased by a return spring. This locking pawl 80 is mounted in the circuit breaker as a double-arm lever so that it can rotate around an axis KA. When the tripping unit is biased, a catch element 36 on the lower end of the double-arm lever actuates the locking pawl 80 against the force of the return spring. A cap 82 that is acted on by the catch element 36 is present on the upper lever arm on the locking pawl 80. After the tripping unit has been biased, the double-arm lever, together with the catch element 36, is in a fixed position, whereby the locking pawl 80 is pried out of its resting position. In this position, the second lever arm 84 of the locking pawl interacts with the latch in such a way that the latter can be moved into the ON position.

The tripping (faulty opening by the electromagnetic control module, possibly in conjunction with an electronic module that is not described in greater detail here) takes place when a sufficiently high current is present in the winding of the tripping coil 12. The magnetic attraction exerted by the permanent magnet 16 is weakened and the solenoid armature 14, assisted by the force of the pressure spring, is released (executing movement L2).

The solenoid armature and the double-arm lever 30 are in positive operative connection via the groove 15 on the tripping tappet and on the prong 35 on the double-arm lever, so that the movement of the solenoid armature is always transmitted to the double-arm lever 30. The linear displacement of the solenoid armature amounts to a few millimeters. The rotational movement (H1, H2) associated with the linear movement (L1, L2) of the double-arm lever 30 is about 25° to 30°. Below the plane of the drawing, a catch means 36 is arranged on the double-arm lever 30 and said catch element 36 interacts with the locking pawl 80 of the latch (opening of the contacts).

The contact system is made to open by the movement L2 of the solenoid armature 14 over the latch.

The drive shaft 40 is in positive operative connection with the latch via a coaxial plug-in connector having catch means (not shown here). The movement of the drive shaft 40 via the drive axis 115 causes the actuation of the latch in both directions of rotation (for ON and OFF).

The tripping unit 10 is accommodated in a plastic housing 11 where essentially the solenoid coil 12 is mounted. The housing 11 is arranged on the top 110 of the circuit breaker, whereby in the embodiment shown, the housing is attached by means of at least one attachment means (screws, connectors or clamps) (here a placement cylinder 19) to mating means (here openings 119 on the top 110). Line AA in the figure shows the spatial association of the placement cylinder 19 with the opening 119.

According to the embodiment, the main axis MA of the tripping unit 10 and thus also the axis of the solenoid armature 14 configured as a tripping tappet is horizontal. The drive shaft 40 has a perpendicular position in the circuit breaker. Therefore, the longitudinal axis of the solenoid armature is at 90° relative to the drive shaft 40.

A bearing SS for the double-arm lever 30 is present on the housing of the tripping unit parallel to the axis HA of the drive shaft 40. The double-arm lever 30 is pivotably attached in the bearing SS by means of the pin 20.

Figure 2:
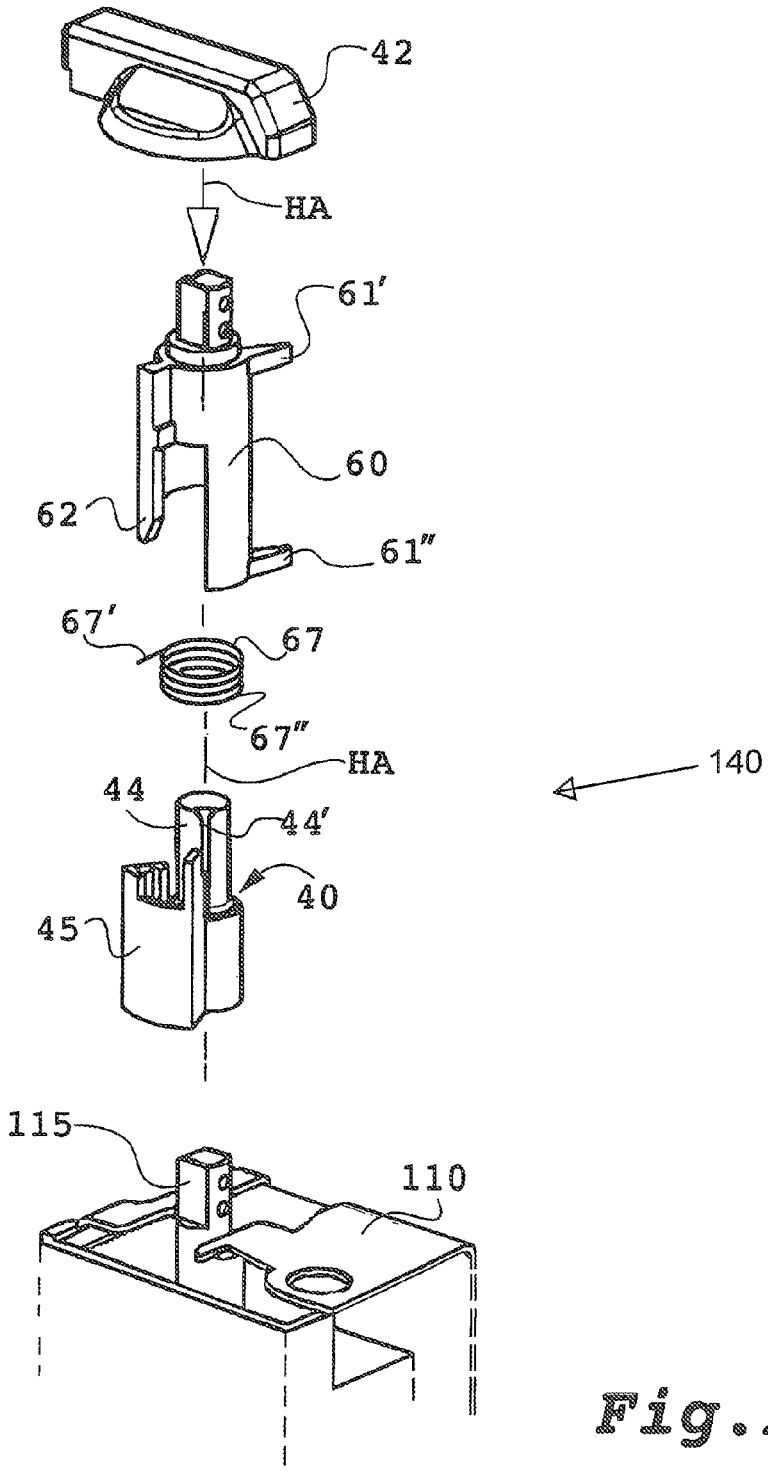
FIG. 2—the assembly of the drive shaft.

The embodiment in FIG. 2 shows that the drive shaft 40 is made up of two parts by mounting an actuating shaft 44 onto a receiving shaft 60. The knob 42, the actuating shaft 44, the receiving shaft 60 and the switch mechanism (indicated by the axis journal 115 in the figure) lie on a shared axis. The lower region of the receiving shaft 60 is hollow and its upper region has a journal to receive the knob. A catch bar 62 and two catch lugs 61', 61" are configured on the receiving shaft so as to be opposite from each other by about 180°. After the assembly, the catch bar 62 engages with the actuating shaft 44 in a catch segment 45 configured there. The edge of the catch bar 62 situated on the front during a clockwise rotation (movement for switching on) lies against the stop in the catch segment 45. Therefore, the actuating shaft 44 is directly carried along during the movement for switching on.

The edge of the catch bar 62 situated on the front during a counterclockwise rotation is the catch means (stop in the catch segment 45) for the manual switching off, whereby a displacement of the torsion spring 67 of about 30° is first overcome, until the actuating shaft 44 is carried along. Thus, a certain amount of play exists between the receiving shaft 60 and the actuating shaft 44, which leaves the actuating shaft 44 disengaged when the receiving shaft 60 executes the resetting movement D1.

The above-mentioned torsion spring 67 is placed between both shafts (44, 60) and after the tripping unit has been biased, this spring serves to reset the receiving shaft vis-à-vis the actuating shaft and moves the drive shaft and especially the knob into an unambiguous OFF position. The end 67' of the spring wire of the torsion spring 67 is bent outwards and lies against the catch bar 62. The second end 67" (not visible in FIG. 2, shown in FIG. 4) of the torsion spring 67 is bent inwards and takes hold in an axially parallel groove 44' of the actuating shaft 44. This upper end of the actuating shaft 44 has a journal that comes to lie in the hollow space of the receiving shaft 60 and, on the lower end, it has a bore for placement onto and attachment to the drive axis 115 of the circuit breaker. FIG. 3 also shows how the catch bar 62 takes hold of the catch segment 45. This catch segment 45 has a free circle segment angle of approximately 50°; the catch bar 62 can move freely between the stops of the catch segment by about 30° (spring displacement of the torsion spring 67). This corresponds to the angular displacement that is used by the biasing movement for the tripping unit.

In order to optimally utilize the space available, the distance of the individual parts with respect to each other is selected so as to be particularly small. The housing of the tripping unit is located especially close to the actuating shaft. This is why two catch lugs are installed on the actuating shaft (receiving shaft 60); a catch lug 61' can graze above the tripping device housing and a catch lug 61" can graze below the tripping device housing.

The receiving shaft 60 establishes an operative connection with the first arm 32 of the double-arm lever 30. The second arm 34, 35 of the double-arm lever 30 is in close operative connection with the solenoid armature 14. In the embodiment shown, this is realized in that the second arm 34 of the double-arm lever 30 is configured as a prong 35 and the tappet-like or bolt-like solenoid armature 14 has a groove 15 on its outer end. The prong 35 of the second arm 34 of the double-arm lever fits positively into the groove of the solenoid armature.

With each linear movement L1, L2 of the solenoid armature 14, the second arm 34 of the double-arm lever is carried along and causes the double-arm to rotate. There is no play in this positive operative connection. The movement of the solenoid armature 14 causes the double-arm lever to rotate and vice versa: the rotation of the double-arm lever causes the solenoid armature to move.

According to the invention, the mechanical operative connection between the solenoid armature 14 and the latch and the mechanical operative connection between the actuating shaft 44 and the solenoid armature 14 are brought about by a receiving shaft 60 suitably configured for both functions.

FIG. 3 shows a horizontal section through the arrangement. The drive shaft 40 is in the OFF position. This figure clearly shows the good utilization of space of the arrangement. The drive shaft is in the OFF position of the circuit breaker.

The actuating motions or the rotational movements will be listed here one more time.

In the "manual switching on" function, the drive shaft 40 is moved out of the OFF position in the direction D2 by being rotated clockwise by 90°, whereby the double-arm lever executes the movement H2. In this process, the armature moves linearly with L1.

In the "manual switching off" function, the drive shaft 40 is moved out of the ON position in the direction D1 by being rotated counterclockwise by 90°, whereby the double-arm lever executes the movement H1. In this process, the armature moves linearly with L2.

In the "tripping unit biasing" function, the drive shaft 40 is moved out of the OFF position in the direction D1 by being rotated counterclockwise by 25°, whereby the double-arm lever executes the movement H1. In this process, the armature is not moved along.

The latter rotational movement can be seen in FIG. 3 on the basis of the two positions of the catch element 61'. In the position shown with the broken line, the receiving shaft 60 with the catch element 61' is held in the resting position by the torsion spring. The position shown with the solid line is one in which the catch element 61' has actuated the double-arm lever 30 (after the rotation D1) and has moved the solenoid armature over to the permanent magnet (with the movement L1).

FIG. 4 shows a view of the tripping unit similar to that of FIG. 3, as well as the double-arm lever and the drive shaft 40. The double-arm lever 30 is shown here in both of its end positions. The drive shaft 40 is in the ON position of the circuit breaker and thus rotated clockwise by 90° relative to the position in FIG. 3. The two biased positions of the torsion springs 67 can be seen here. Since the catch bar 62 (not shown here, see FIG. 2) is carried along, the first end 67' of the torsion spring has been moved from a position indicated by a broken line into a position indicated by a solid line. Likewise visible is the groove 44' of the actuating shaft (also see FIG. 2 here). The second end 67" of the torsion spring 67 lies in this groove.

FIG. 4 additionally shows a design possibility for purposes of rendering the position of the double-arm lever visible. A colored marking 35' can be placed on one arm 34 of the double-arm lever 30. Since the double-arm lever is in a rigid relationship relative to the solenoid armature, this marling can be employed to indicate whether the tripping unit is in the reset position. According to FIG. 4, the marking is present on the tripping device side (34) of the double-arm lever 30. The double-arm lever is depicted in two positions (shown by a broken line and by a solid line). A window F is arranged in the housing (not shown here) of the circuit breaker above the position of the arm 34 of the double-arm lever 30. Depending on the envisaged function, a green or red marking 35' can be provided. The marking is either visible or not visible, depending on the position of the double-arm lever 30. Therefore, either the tripped position (red marking) or the reset position (green marking) of the tripping unit can be made visible in the window from the outside by means of the marking 35'. Consequently, the user can immediately see whether the circuit breaker can be switched on, without resetting, or whether the tripping unit still has to be reset before the circuit breaker can be switched on.

The invention claimed is:

1. An electrical circuit breaker having a protective function in case of a fault, the circuit breaker comprising:

a switch mechanism moveable between an ON position and an OFF position;

an electromagnetic tripping unit configured to act mechanically on the switch mechanism in response to a switch-OFF command, the tripping unit including:

a tripping coil;

an actuator unit configured as a rotating mechanism for moving the switching mechanism between the ON and OFF positions as well as for resetting the tripping unit after a trip, the actuator unit having a drive shaft operatively connected to the switch mechanism;

a pressure spring;

a solenoid armature configured as a tripping tappet disposed in the tripping coil, the pressure spring biasing the solenoid armature in a tripping direction;

a permanent magnet holding the solenoid armature in the ON position of the switch mechanism and in a reset state of the tripping unit when the tripping coil is without power supply;

a tripping lever rotatable by the solenoid armature and acting on the switch mechanism; and a mechanical operative connection disposed between the drive shaft and the tripping unit, the mechanical operative connection configured to reset the tripping unit when the drive shaft is moved out of the OFF position in a direction opposite from a rotational movement for switching on, wherein the mechanical operative connection includes a double-arm lever having a first arm acted upon by at least one catch device on the drive shaft and having a second arm configured to bring about the resetting movement of the tripping unit, and the mechanical operative connection is configured so that a rotation of the drive shaft is converted into a counter-rotation of the double-arm lever and the rotation of the double-arm lever becomes a linear movement of the solenoid armature, and wherein the second arm includes a prong and in the solenoid armature includes a groove configured to engage with the prong.

2. The circuit breaker as recited in claim 1, wherein the double-arm lever is disposed axially parallel to the actuating shaft and the solenoid armature is disposed perpendicular to the double-arm lever.

3. The circuit breaker as recited in claim 1, wherein the mechanical operative connection is configured so that a rotational movement of the drive shaft at an angular displacement of 20° to 30° in the direction opposite from the rotational movement for switching on is sufficient for the resetting movement.

4. The circuit breaker as recited in claim 1, wherein the drive shaft includes a receiving shaft disposed on the switch mechanism and having at least one catch for the double-arm lever and an actuating shaft acting rigidly on the switch mechanism, wherein a degree of play exists between the receiving shaft and the actuating shaft sufficient to leave the actuating shaft disengaged when the receiving shaft executes the resetting movement.

5. The circuit breaker as recited in claim 1, further comprising a housing having a window and wherein one of the first and second arms includes a marking visible through the window when the tripping unit is in at least one of the reset position and the tripped position.

6. An electrical circuit breaker having a protective function in case of a fault, the circuit breaker comprising:

a switch mechanism moveable between an ON position and an OFF position;

an electromagnetic tripping unit configured to act mechanically on the switch mechanism in response to a switch-OFF command, the tripping unit including:

a tripping coil;

an actuator unit configured as a rotating mechanism for moving the switching mechanism between the ON and OFF positions as well as for resetting the tripping unit after a trip, the actuator unit having a drive shaft operatively connected to the switch mechanism;

a pressure spring;

a solenoid armature configured as a tripping tappet disposed in the tripping coil, the pressure spring biasing the solenoid armature in a tripping direction;

a permanent magnet holding the solenoid armature in the ON position of the switch mechanism and in a reset state of the tripping unit when the tripping coil is without power supply;

a tripping lever rotatable by the solenoid armature and acting on the switch mechanism; and a mechanical operative connection disposed between the drive shaft and the tripping unit, the mechanical operative connection configured to reset the tripping unit when the drive shaft is moved out of the OFF position in a direction opposite from a rotational movement for switching on, wherein the mechanical operative connection includes a double-arm lever having a first arm acted upon by at least one catch device on the drive shaft and having a second arm configured to bring about the resetting movement of the tripping unit, and wherein the drive shaft includes a receiving shaft disposed on the switch mechanism and having at least one catch for the double-arm lever and an actuating shaft acting rigidly on the switch mechanism, wherein a degree of play exists between the receiving shaft and the actuating shaft sufficient to leave the actuating shaft disengaged when the receiving shaft executes the resetting movement.

* * * * *